US006367794B1

(12) United States Patent
Godwin et al.

(10) Patent No.: US 6,367,794 B1
(45) Date of Patent: Apr. 9, 2002

(54) ENCLOSURE FEEDER WITH LEDGE-EXTENSION FINGERS

(75) Inventors: Donna L. Godwin, Beacon Falls; Wayne W. Ritchie, Fairfield, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/473,422

(22) Filed: Dec. 29, 1999

(51) Int. Cl.[7] ..... B65H 43/00

(52) U.S. Cl. ..... 270/58.26; 270/58.23; 270/58.29

(58) Field of Search ..... 270/58.26, 58.29, 270/58.23, 52.16; 198/735.1, 735.5

(56) References Cited

U.S. PATENT DOCUMENTS 2,427,839 A * 9/1947 Davidson ..... 270/58.29
2,975,576 A * 3/1961 Garapolo ..... 53/291
3,414,257 A * 12/1968 Muller ..... 270/58.29
4,511,132 A * 4/1985 Muller ..... 270/58.29
4,801,036 A * 1/1989 Rathert ..... 270/58.29
5,273,265 A * 12/1993 Edwards ..... 270/58.26 X
5,575,612 A * 11/1996 Uno ..... 414/788.9

* cited by examiner

*Primary Examiner*—Donald P. Walsh
*Assistant Examiner*—Patrick Mackey
(74) *Attorney, Agent, or Firm*—Michael J. Cummings; Michael E. Melton

(57) ABSTRACT

A method and system for gathering enclosure documents for insertion in an envelope inserting system having a plurality of enclosure feeders for releasing enclosure documents and a plurality of pusher fingers mounted on a pair of endless chains for gathering the released documents. A plurality of flexible extension fingers are connected to the downstream end of enclosure feeder so as to support the released document before the released document is pushed off by a pair of pusher fingers onto a chassis deck. The downstream ends of the flexible extension fingers form a gap with the chassis deck, allowing the documents released upstream to pass under the extension fingers so that the document released from an enclosure feeder is stacked on top of the documents released from the upstream feeders. Because the extension fingers are flexible, the gap under the extension fingers can be widened by a stack of documents released upstream. Preferably, a centering device is installed downstream from each enclosure feeder to guide the released document.

3 Claims, 7 Drawing Sheets

ENCLOSURE FEEDER WITH LEDGE-EXTENSION FINGERS

TECHNICAL FIELD

The present invention relates to enclosure feeders in an envelope inserting machine for mass mailing.

BACKGROUND OF THE INVENTION

In an envelope inserting machine for mass mailing, there is a gathering section where the enclosure material is gathered before it is inserted into an envelope. This gathering section is sometimes referred to as a chassis subsystem, which includes a gathering transport with pusher fingers rigidly attached to a conveying mechanism and a plurality of enclosure feeders mounted above the gathering transport for releasing the enclosure material onto the gathering transport. If the enclosure material contains many documents, these documents must be separately fed from different enclosure feeders. Envelope inserting systems and enclosure feeders have been disclosed in the past. For example, U.S. Pat. No. 4,169,341 (Roetter et al) discloses an envelope inserting system having a plurality of enclosure feeders and a gathering transport. As shown in FIG. 1, such an envelope inserting system has a number of feeding stations or enclosure feeders over a longitudinally extending deck. Each enclosure feeder has a hopper capable of holding documents therein, and a plurality of rollers to release the documents, one at a time, to a ledge plate. Also shown in FIG. 1 are a plurality of pusher fingers fixedly mounted on a pair of endless chains which run along the deck for pushing the released documents off the ledge plates onto the deck. As shown in FIG. 2, the pusher fingers are arranged in pairs and the distance between two adjacent pairs of pusher fingers is substantially equal to the distance between two adjacent enclosure feeders. Moreover, the endless chains are substantially parallel to each other from the upstream end to the envelope insertion area. The endless chains move in synchronism and in constant speed. The pusher fingers are also used to push the released enclosure documents toward the envelope insertion area. As these pusher fingers move from the upstream end of the envelope inserting system toward the downstream end, each pair of pusher fingers gathers one released document from each releasing enclosure feeder and the gathered documents are stacked and collated while they are pushed toward the envelope insertion area for insertion.

It should be noted that the ledge plates as shown in FIG. 1 and FIG. 2 are rigid in construction. The downstream end of each ledge plate has a fixed gap from the deck so as to allow the documents gathered from the upstream enclosure feeders to move through the gap of the downstream enclosure feeders. As such, the document released from a downstream enclosure feeder is stacked on top of the documents released from the upstream enclosure feeders. While it is not desirable to have a large gap between the ledge plate and the deck because a large gap tends to make collating of the gathered documents more difficult, a small gap limits the number of documents that can be gathered by the pusher fingers. Furthermore, the width of the ledge plates must be made to match the size of the released documents and the separation between the endless chains. Moreover, the ledge plate requires a precision positioning of the document released onto it. If the document is released too far downstream, the document would tip off the downstream end of the ledge plate, elevating the trailing edge of the released document. A jam caused by the pusher finger would result.

It is advantageous and desirable to provide a method and device for releasing and gathering documents in an envelope inserting machine to overcome the aforementioned disadvantages associated with the ledge plates.

SUMMARY OF THE INVENTION

The first aspect of the present invention is to provide an enclosure feeder wherein a plurality of ledge-extension fingers are used to support a sheet of enclosure material released from an enclosure feeder. The ledge-extension fingers are flexible so that the gap between the downstream end of the ledge-extension fingers and the transport deck can be made small so as to help the stacking and collating of the release documents. At the same time, the number of the documents to be inserted into an envelope can be increased because the ledge-extension fingers can be pushed upward by the gathered documents to widen the gap when the gathered documents move through the gap.

The second aspect of the present invention is to provide an envelope inserting system having an envelope feeder, a plurality of enclosure feeders, and a gathering mechanism moving from the downstream end of the envelope inserting system toward an envelope insertion area at the upstream end, wherein each enclosure feeder has a plurality of ledge-extension fingers and can be used to release enclosure documents one at a time onto the ledge-extension fingers so as to allow the gather mechanism to collect the release documents in an orderly fashion and move the release documents downstream. The envelope inserting system further includes at least one centering device for centering the released documents while the released documents are moved by the gather mechanism downstream.

The third aspect of the present invention is to provide a method of gathering enclosure documents for insertion into an envelope inserting system having a plurality of enclosure feeders to release the enclosure documents. The method comprises the steps of providing a plurality of enclosure documents on at least one enclosure feeder, releasing documents from said at least one enclosure feeder one at a time onto a plurality of flexible ledge-extension fingers, pushing the released documents off the ledge-extension fingers in order to move the released documents downstream, and centering the released documents while they are pushed downstream.

The object and the scope of the present invention will become apparent upon reading the description taken in conjunction with FIG. 3 to FIG. 6.

DETAILED DESCRIPTION

Figure 1:
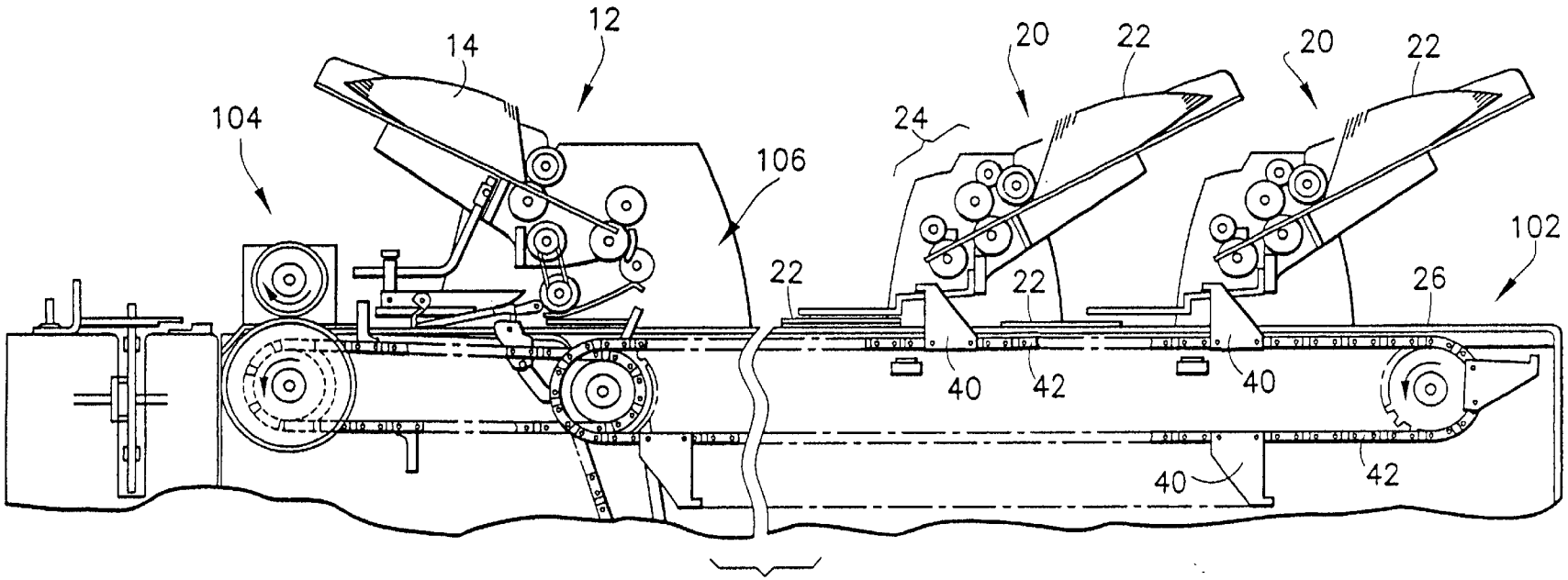
FIG. 1 PRIOR ART
FIG. 1 is a side view of a prior art envelope inserting system showing an envelope feeder for releasing one envelope at a time onto an envelope insertion area and a plurality of enclosure feeders for releasing enclosure documents onto a gathering mechanism.
Figure 2:
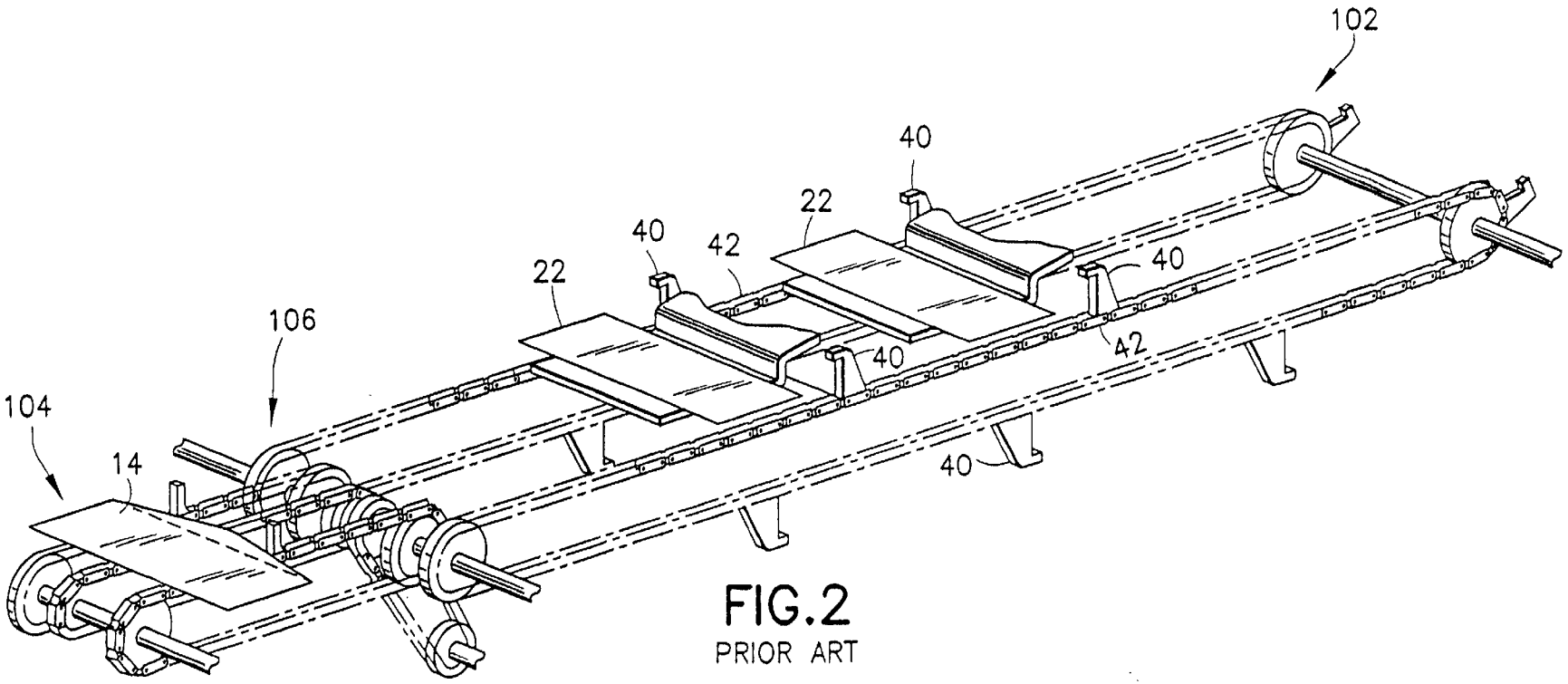
FIG. 2 PRIOR ART
FIG. 2 is an isometric view of part of the prior art envelope inserting system of FIG. 1, showing the ledge plate on each enclosure feeder for supporting the release document.
Figure 3:
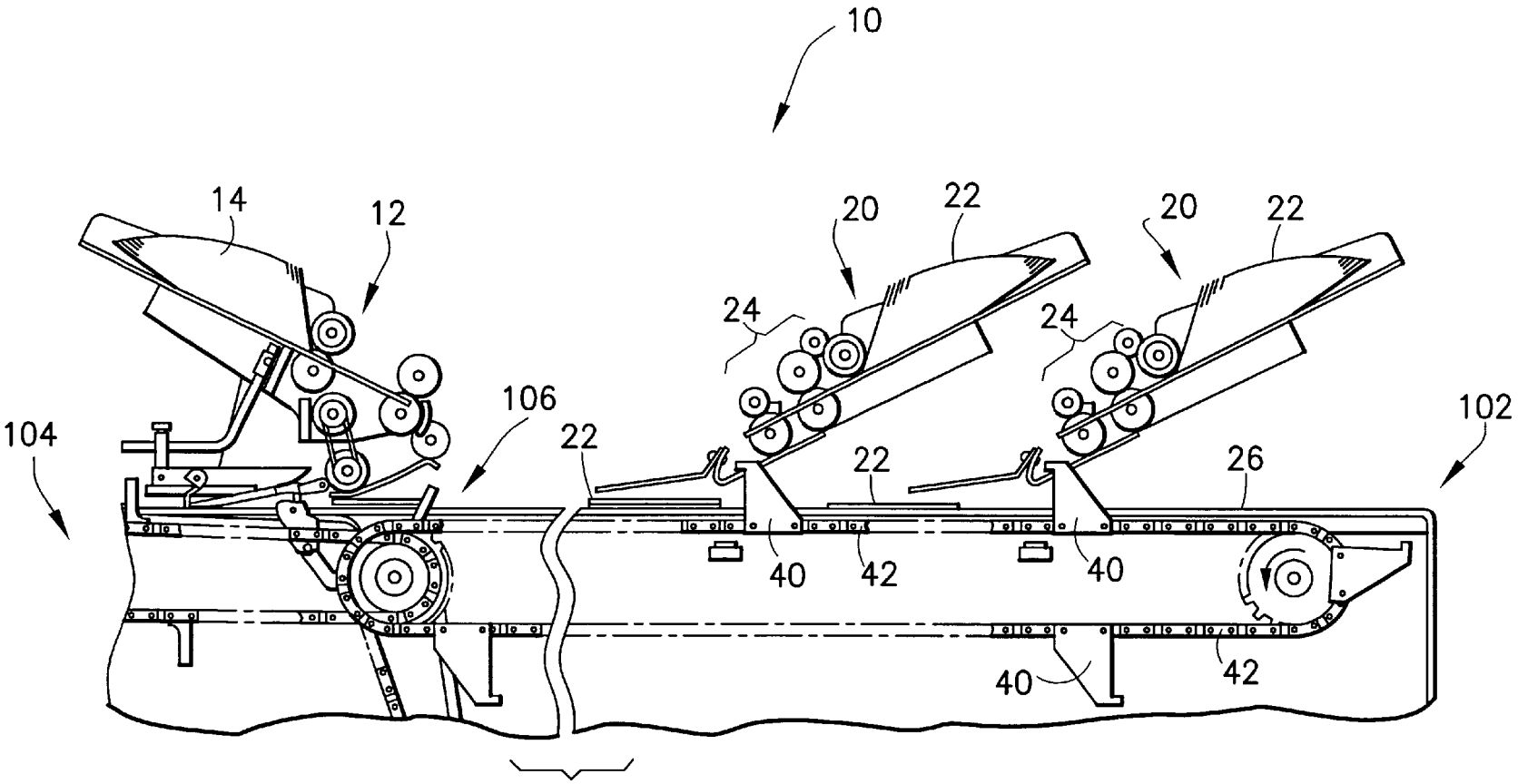
FIG. 3 is a side view of the envelope inserting system of the present invention, showing an envelope feeder and a plurality of enclosure feeders.

As shown in FIG. 3, the envelope inserting system 10 of the present invention has an upstream end 102 and a downstream end 104, wherein an envelope feeder 12 is used for feeding envelopes 14 onto an envelope insertion area 106 at the downstream end 104 and a plurality of enclosure feeders 20 for feeding enclosure documents 22 to be inserted into the envelopes 14 released onto the envelope insertion area 106. As shown, each enclosure feeder 20 has a plurality of rollers 24 for releasing the documents 22 onto a chassis deck 26. The released documents 22 are gathered and pushed downstream by a plurality of pusher fingers 40 mounted on two endless chains 42 (see FIGS. 5 and 6). The endless chains 42 carry the pusher fingers from the upstream end 102 to the envelope insertion area 106. It is preferred that the endless chains 42 move in synchronism with each other and in constant speed.

Figures 4, 4A:
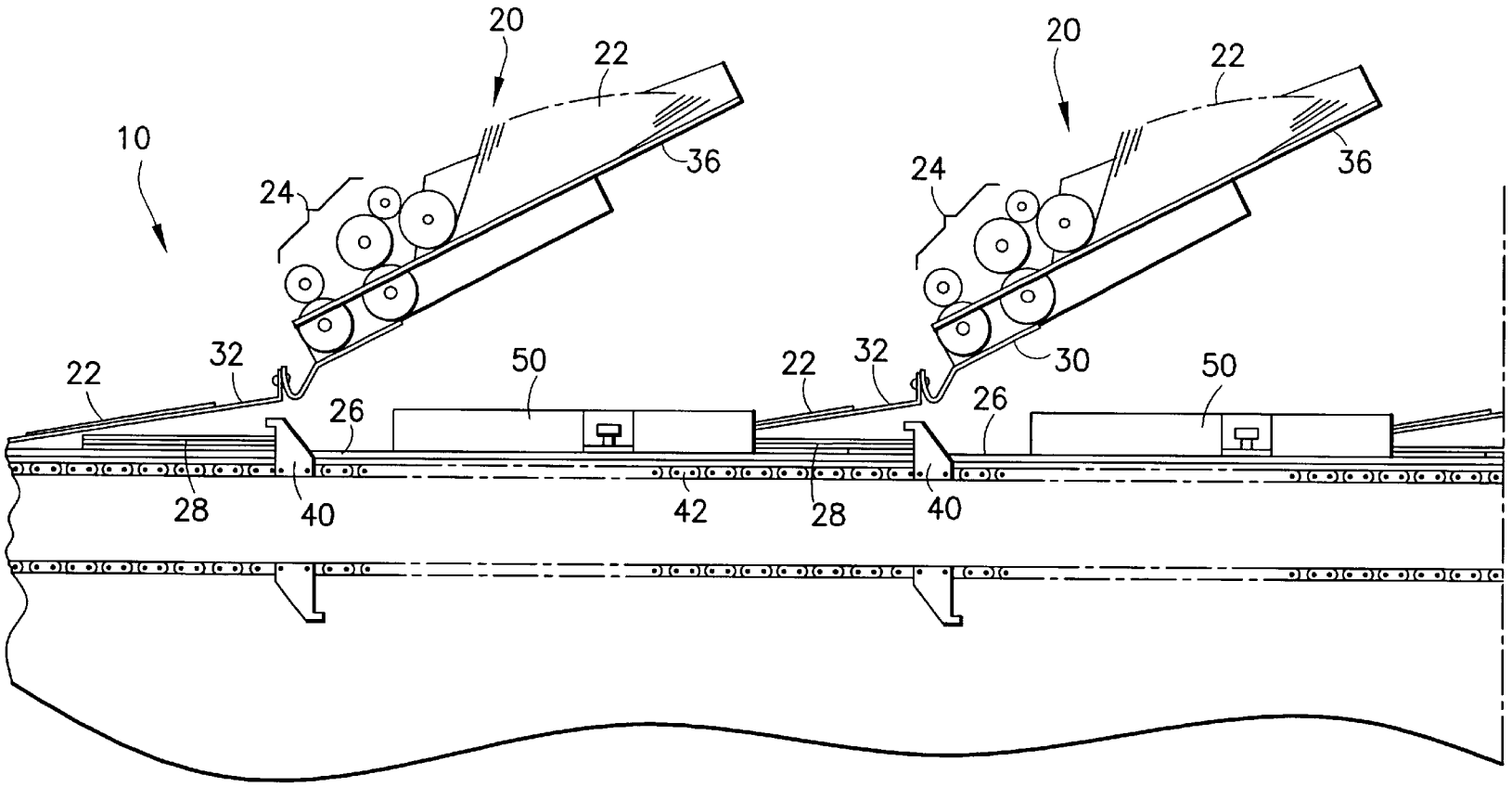
FIG. 4A and FIG. 4B illustrate the side view of the envelope inserting system of the present invention, showing the ledge-extension fingers and the centering device of the envelope inserting system.

As shown in FIG. 4A, each enclosure feeder 20 has a tray 36 for holding the enclosure documents 22. Connected to the downstream end of the tray 36 is a ledge 30 for mounting a plurality of ledge-extension fingers 32. The ledge-extension fingers 32 are used to hold the released documents 22 before the released documents 22 are pushed by the pusher fingers 40 toward the envelope insertion area 106 (FIG. 3). As a pair of pusher fingers 40 move downstream, they pick up more and more released documents 22 and collate the released documents 22 in a document stack 28. Also shown in FIG. 4A are a plurality of centering devices 50 for centering the released documents 22 as the released documents 22 are pushed off the ledge-extension fingers 32 and moved downstream.

Figure 4B:
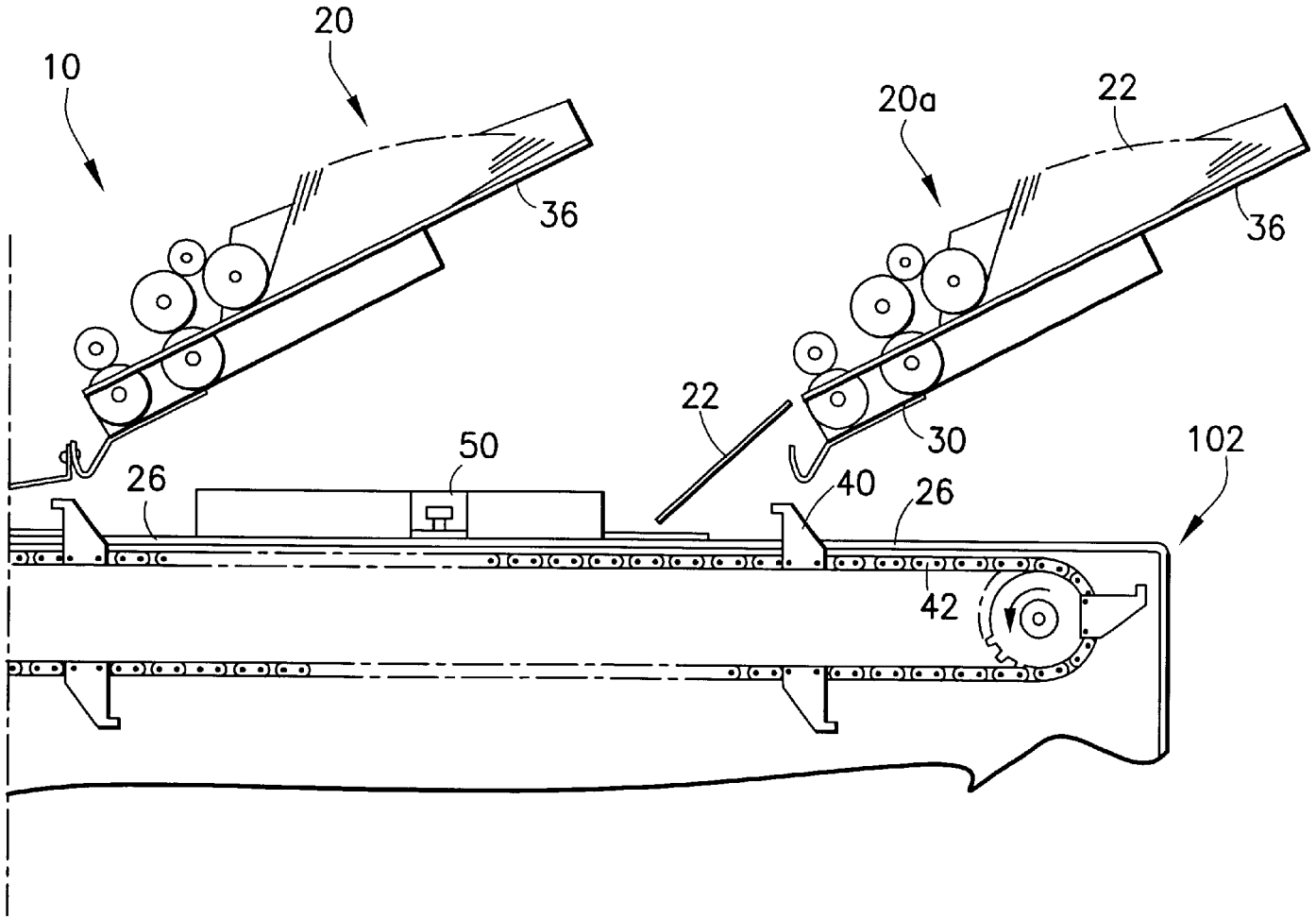

FIG. 4B shows the upstream end 102 of the envelope inserting system 10 and the first enclosure feeder 20*a*. Because a document 22 released from the first enclosure feeder 20*a* is the first document in a document stack 28, there is no need for collation at this stage. Therefore, there is no need to install the ledge-extension fingers 32 on the first enclosure feeder 20*a*.

Figure 5:
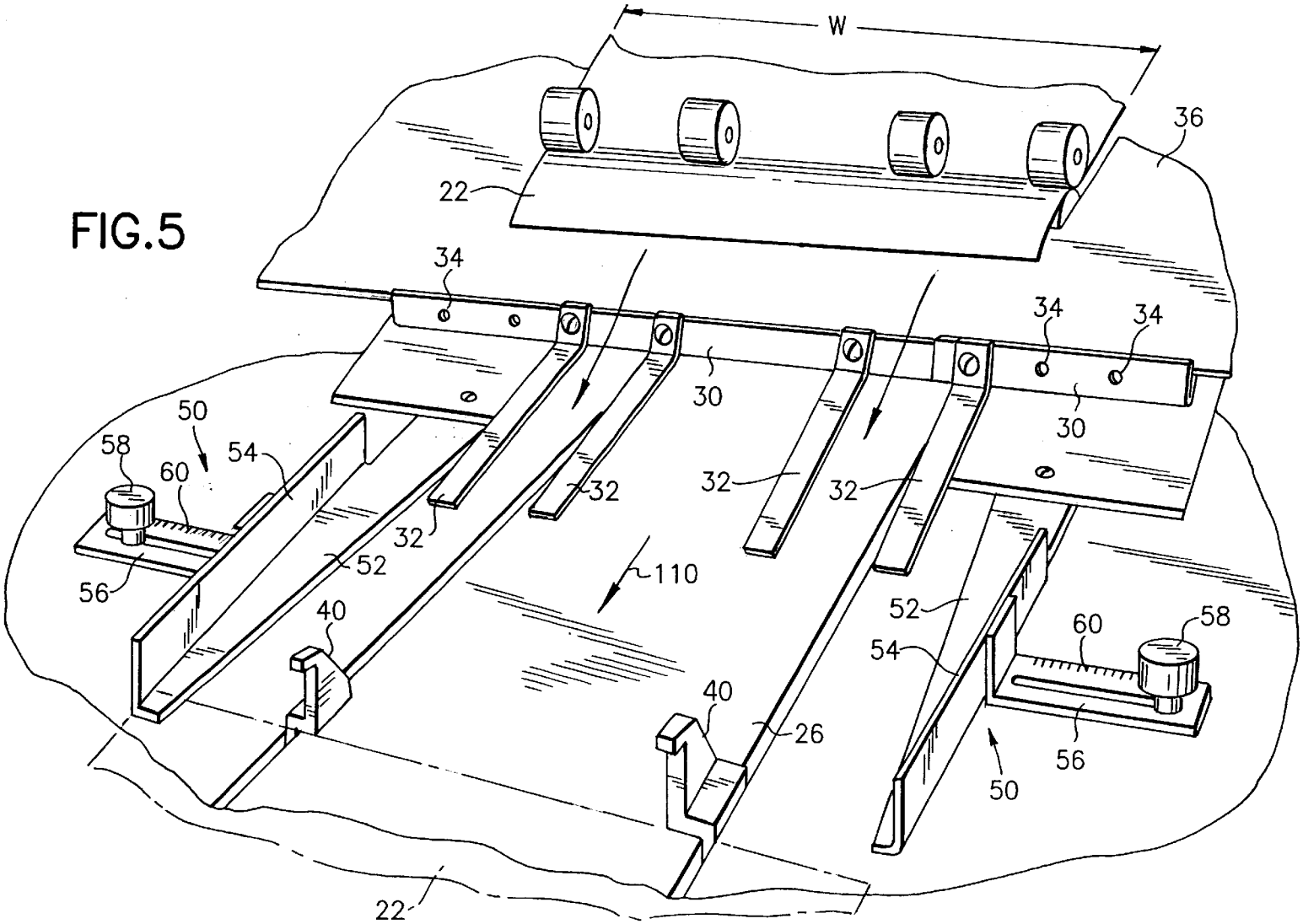
FIG. 5 is a perspective representation of the enclosure feeder of the present invention, showing a plurality of ledge-extension fingers extending from a ledge of the enclosure feeder, and a centering device mounted downstream from the enclosure feeder.

As shown in FIG. 5, a plurality of ledge-extension fingers 32 are mounted on a number of selected mounting holes 34 on the ledge 30. In this illustration, four ledge-extension fingers 32 are used to support a released document 22 released from the tray 36. However, the number of ledge-extension fingers 32 mounted on each enclosure feeder 20 can be smaller or greater than four, depending on the width w and the weight of the documents 22. Furthermore, the ledge-extension fingers 32 can be mounted on different mounting holes 34 to accommodate any enclosure document 22 within the machine specification without modification.

Also shown in FIG. 5 are two centering devices 50, mounted on the opposite sides of an enclosure feeder 20 and downstream from the enclosure feeder 20. The two centering devices 50 are mirror images of each other. Each centering device 50 comprises a jogger 52, a guiding wall 54, a mounting bracket 56 and a locking knob 58. The joggers 52 are used to support a released document 22 when the document 22 is pushed off the ledge-extension fingers 32 by a pair of pusher fingers 40. The guiding walls 54 are used to keep the document 22 in place when the document 22 is released and then moved downstream along a direction 110. Preferably, the mounting position of the centering device 50 is adjustable to suit the width w of the enclosure documents 22. After the mounting position of the centering device 50 is properly adjusted, the mounting bracket 56 is secured by the lock knob 58. Preferably, the mounting bracket 56 has scale marks 60 to help center the centering devices 50 on both side of the endless chains 44 as shown in FIG. 6.

Figure 6:
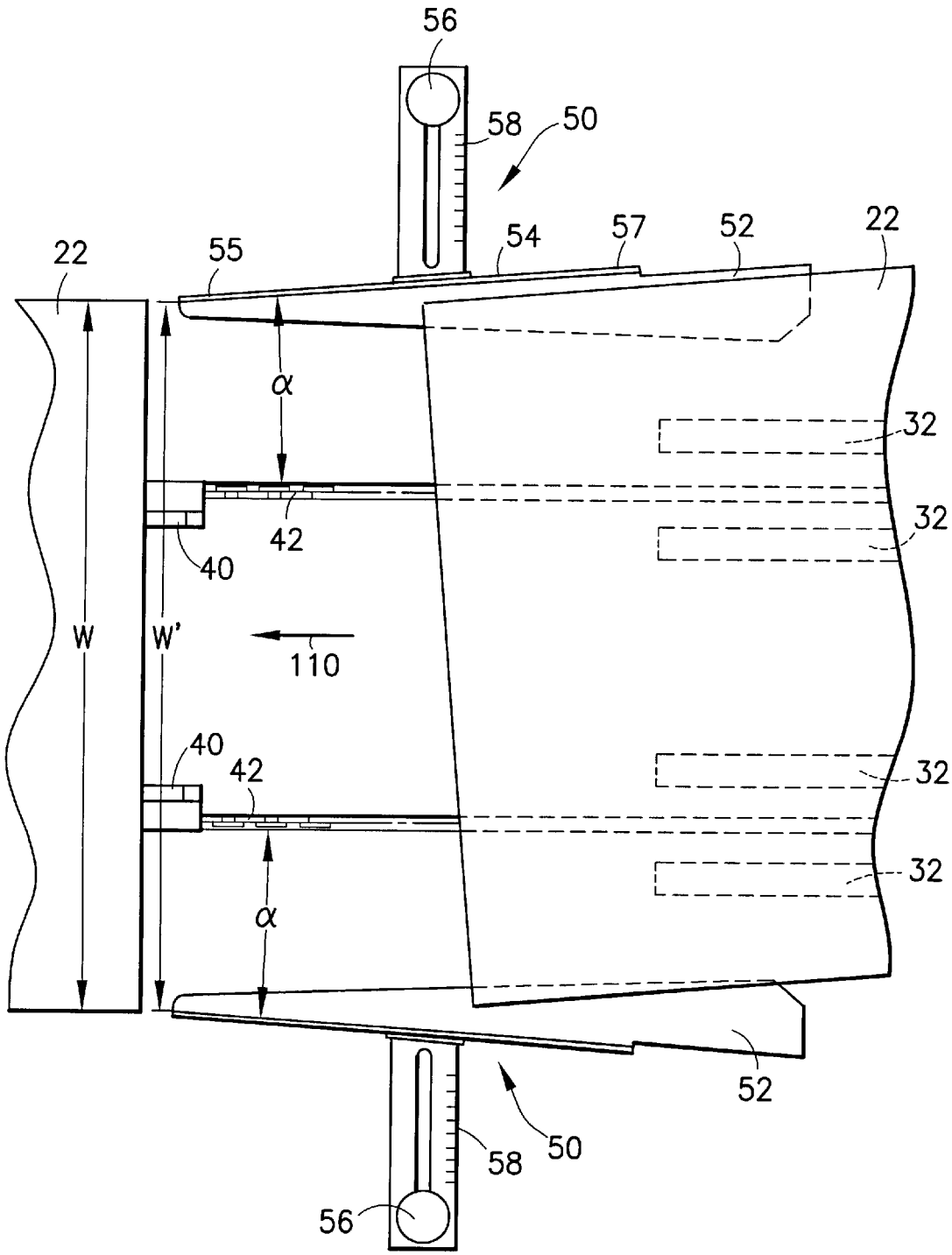
FIG. 6 is a top view of the envelope inserting system, showing in detail the document centering devices.

As shown in FIG. 6, the distance from the endless chain 42 to the downstream end 55 of the guiding wall 54 is closer than the distance to the upstream end 57, and the angle $\alpha$ between the guiding wall 54 and the endless chain 42 is greater than zero degrees. Accordingly, the guiding walls 54 of the centering device pair 50 form a funneling angle which is equal to $2\alpha$. Preferably, the distance w= between the opposing guiding walls 54 at the downstream end 55 is slightly greater than the width w of the enclosure document 22. Even when the enclosure document 22 is tilted or off-centered as it is released onto the ledge-extension FIGS. 32, the released documents 22 can be centered when they are pushed off the ledge-extension fingers 32 by the pusher fingers 40, with the help of the guiding walls 55.

What has been described above is an enclosure feeder to be used in an envelope inserting machine. However, the ledge-extension fingers on the enclosure feeder as described in conjunction with FIGS. 3–6 can be used in any sheet feeders where collation of a plurality of sheets released from the feeders is required. Moreover, the drawings as shown in FIGS. 3–6 are for illustrative purposes only. They are intended primarily for explaining the principle of supporting a sheet of document released from a feeder until the released sheet is gathered by a gathering mechanism which carries along the documents gathered upstream, and the principle of centering the released sheet as it is pushed off the supporting device.

Therefore, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An enclosure feeder for releasing enclosure documents in an envelope inserting system, wherein the envelope inserting system comprises a gathering mechanism to gather the released enclosure documents and transporting the released enclosure documents to an envelope insertion area to be inserted into an envelope, said enclosure feeder comprising:

a tray to support the enclosure documents, the enclosure documents having a width;

a plurality of extension fingers located adjacent to the tray;

a releasing mechanism to sequentially release one document from the tray onto the extension fingers so as to allow the gathering mechanism to gather the released document; and a ledge having a plurality of mounting holes for mounting the extension fingers, the extension fingers being adjustably spaced from each other by selectable mounting in the mounting holes in order to suit the width of the enclosure documents.

2. The enclosure feeder of claim 1, wherein the extension fingers are flexible.

3. The enclosure feeder of claim 1, wherein the envelope inserting system has an upstream end and a downstream end and the envelope insertion area is located at the downstream end, and wherein the gathering mechanism comprises at least one endless chain and a plurality of pusher fingers mounted on the endless chain to remove the released document from the extension fingers so as to allow the released document to move along with the endless chain downstream.

* * * * *